US011821223B2

(12) United States Patent
Rakhmatulin et al.

(10) Patent No.: US 11,821,223 B2
(45) Date of Patent: Nov. 21, 2023

(54) SCAFFOLD TRANSPORT SYSTEM, METHOD FOR CONTROLLING A SCAFFOLD TRANSPORT SYSTEM AND USE OF A SCAFFOLD TRANSPORT SYSTEM

(71) Applicant: Kewazo GmbH, Gilching (DE)

(72) Inventors: Alimzhan Rakhmatulin, Gilching (DE); Leonidas Pozikidis, Gilching (DE); Sebastian Weitzel, Gilching (DE); Eirini Psallida, Gilching (DE); Ekaterina Grib, Gilching (DE); Artem Kuchukov, Gilching (DE)

(73) Assignee: KEWAZO GMBH

( * ) Notice: Subject to any disclaimer, the term of this patent is extended or adjusted under 35 U.S.C. 154(b) by 284 days.

(21) Appl. No.: 16/611,776

(22) PCT Filed: May 8, 2018

(86) PCT No.: PCT/EP2018/061847
§ 371 (c)(1),
(2) Date: Nov. 7, 2019

(87) PCT Pub. No.: WO2018/206566
PCT Pub. Date: Nov. 15, 2018

(65) Prior Publication Data

US 2020/0095784 A1 Mar. 26, 2020

(30) Foreign Application Priority Data

May 8, 2017 (DE) ..... 10 2017 109 839.9

(51) Int. Cl.
*E04G 5/00* (2006.01)

(52) U.S. Cl.
CPC ..... *E04G 5/00* (2013.01); *E04G 2005/008* (2013.01)

(58) Field of Classification Search
CPC ..... E04G 5/00; E04G 2005/008; E04G 2003/283; E04G 2003/286; E04G 3/28;
(Continued)

(56) References Cited

U.S. PATENT DOCUMENTS 638,080 A * 11/1899 Treadway ..... E04G 1/20 182/174
1,393,932 A * 10/1921 Andre ..... E04G 1/20 182/132
(Continued)

FOREIGN PATENT DOCUMENTS

CA 2296856 A1 * 4/2001 ..... E04G 1/20
DE 2232739 A1 1/1973
(Continued)

OTHER PUBLICATIONS

International Search Report; Application No. PCT/EP2018/061847; dated Jun. 28, 2018; 2 pages.

*Primary Examiner* — Jessica L Laux
*Assistant Examiner* — Kathleen M. McFarland
(74) *Attorney, Agent, or Firm* — Dilworth IP, LLC

(57) ABSTRACT

A scaffold transport system is described with a rail system having at least one horizontally running rail section, and at least one carriage module, which is designed to move along the rail system. The carriage module has a coupling section via which the carriage module is captively and movably coupled to the rail system, and a carrier section by means of which the carriage module carries objects during the movement.

13 Claims, 10 Drawing Sheets

(58) Field of Classification Search
CPC ... E04G 1/20; E04G 7/22; E04G 21/00; B66F 11/04; B66B 9/187; B66B 1/306; Y10S 187/90
See application file for complete search history.

(56) References Cited

U.S. PATENT DOCUMENTS

| | | | | |
|---|---|---|---|---|
| 1,761,353 | A * | 6/1930 | Manning | B66B 9/16 104/92 |
| 3,313,376 | A * | 4/1967 | Holland, Sr. | E04G 1/20 187/241 |
| 3,548,970 | A * | 12/1970 | Hutchens, Sr. | E04G 1/20 182/141 |
| 3,880,256 | A * | 4/1975 | Couris | E04G 1/20 182/136 |
| 3,896,736 | A | 7/1975 | Hamy | |
| 4,262,773 | A * | 4/1981 | Basham | B66B 9/187 187/244 |
| 5,067,587 | A * | 11/1991 | Mims, Jr. | B66F 11/04 182/69.6 |
| 5,159,993 | A * | 11/1992 | St-Germain | E04G 1/20 182/229 |
| 5,992,565 | A * | 11/1999 | Lingen | B66B 9/16 182/141 |
| 6,170,608 | B1 * | 1/2001 | Gresser | E04G 1/20 193/35 R |
| 6,308,818 | B1 * | 10/2001 | Bonora | B65G 35/06 198/465.1 |
| 7,014,011 | B1 * | 3/2006 | Alexander | E04G 5/00 52/651.1 |
| 7,281,607 | B1 | 10/2007 | Kiraly | |
| 7,381,022 | B1 * | 6/2008 | King | B65G 1/1375 414/807 |
| 7,665,582 | B2 * | 2/2010 | Lindh | B66B 9/187 182/2.1 |
| 8,527,153 | B2 * | 9/2013 | Doan | G05D 1/0891 280/755 |
| 8,734,079 | B1 * | 5/2014 | Razumov | B65G 1/0492 414/331.14 |
| 8,919,532 | B2 * | 12/2014 | Buergermeister | B61B 5/00 198/465.1 |
| 9,334,114 | B2 * | 5/2016 | Salichs | B65G 1/026 |
| 9,598,265 | B1 * | 3/2017 | Jacobs | B66B 9/003 |
| 9,884,720 | B2 * | 2/2018 | Van Den Berk | B65G 1/0492 |
| 10,309,094 | B2 * | 6/2019 | Avelin | E04B 1/003 |
| 10,442,621 | B2 * | 10/2019 | Bestic | B65D 81/2015 |
| 10,913,641 | B2 * | 2/2021 | Gravelle | B66F 9/122 |
| 10,934,099 | B2 * | 3/2021 | Wireman | B65G 54/02 |
| 10,961,054 | B2 * | 3/2021 | Gravelle | B65G 1/0464 |
| 11,104,547 | B2 * | 8/2021 | Dayrell | B66B 9/022 |
| 11,142,398 | B2 * | 10/2021 | Lert, Jr. | B65G 1/0492 |
| 11,203,486 | B2 * | 12/2021 | Lert, Jr. | B65G 1/0435 |
| 2005/0087393 | A1 * | 4/2005 | Korchagin | B66B 9/16 182/131 |
| 2006/0144639 | A1 * | 7/2006 | Iacoviello, Jr. | E04G 3/28 182/82 |
| 2007/0271863 | A1 * | 11/2007 | Lindh | B66B 9/187 52/239 |
| 2010/0252645 | A1 | 10/2010 | Maurer et al. | |
| 2013/0081902 | A1 * | 4/2013 | Liao | E04G 3/28 182/20 |
| 2013/0206506 | A1 * | 8/2013 | Keersmaekers | E04G 5/007 182/36 |
| 2013/0341122 | A1 | 12/2013 | Maurer et al. | |
| 2015/0184402 | A1 * | 7/2015 | Gardner | G06F 1/3231 182/131 |
| 2016/0075533 | A1 * | 3/2016 | Scomparin | B61B 5/02 104/124 |
| 2017/0088399 | A1 * | 3/2017 | Jacobs | B66B 9/16 |
| 2017/0260008 | A1 * | 9/2017 | DeWitt | B65G 43/08 |
| 2017/0267452 | A1 * | 9/2017 | Goren | B65G 1/0492 |
| 2018/0319630 | A1 * | 11/2018 | Dayrell | B66B 9/003 |
| 2019/0309532 | A1 * | 10/2019 | Buck | B66B 9/022 |
| 2020/0095784 | A1 * | 3/2020 | Rakhmatulin | E04G 5/00 |

FOREIGN PATENT DOCUMENTS

| | | | |
|---|---|---|---|
| DE | 29808022 | U1 | 8/1998 |
| DE | 69901777 | T2 | 3/2005 |
| EP | 0670399 | B1 | 7/1997 |
| EP | 1016615 | B1 | 7/2000 |
| EP | 1023237 | B1 | 5/2001 |
| GB | 2460622 | A | 12/2009 |
| WO | 9919244 | A1 | 4/1999 |
| WO | 2012006694 | A1 | 1/2012 |
| WO | 2016009423 | A1 | 1/2016 |
| WO | 2017155459 | A1 | 9/2017 |

* cited by examiner

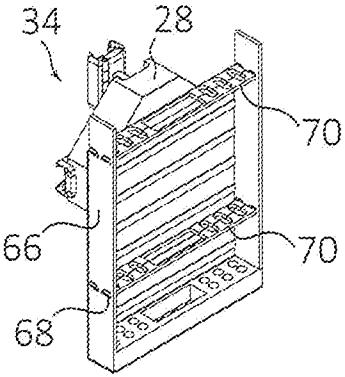
Fig. 7a
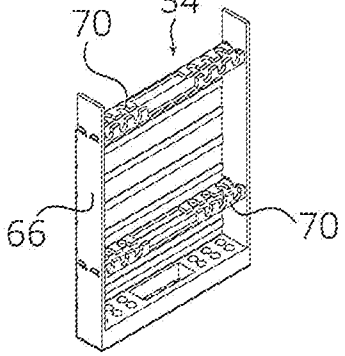
Fig. 7b
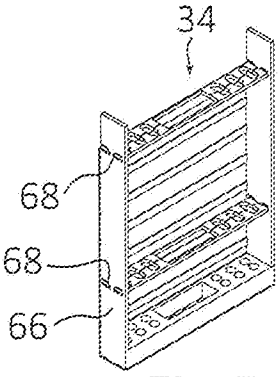
Fig. 7c
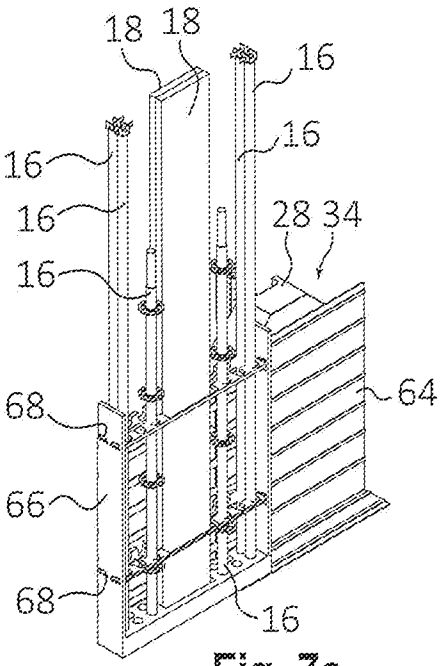
Fig. 7d
Fig. 7e
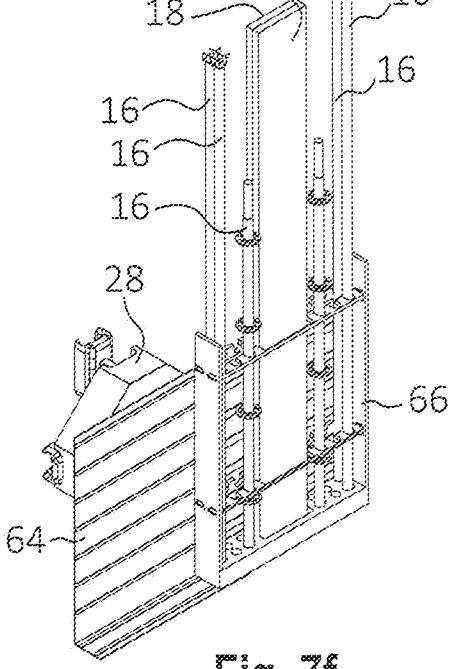
Fig. 7f

SCAFFOLD TRANSPORT SYSTEM, METHOD FOR CONTROLLING A SCAFFOLD TRANSPORT SYSTEM AND USE OF A SCAFFOLD TRANSPORT SYSTEM

The invention relates to a scaffold transport system, a method for controlling a scaffold transport system and the use of a scaffold transport system and/or of a method for controlling a scaffold transport system.

BACKGROUND OF THE INVENTION

It is known from the state of the art that additional lift systems are used during the erection and the dismantling of scaffolding via which material can be delivered to higher tiers of the scaffolding. The tiers of the scaffolding represent horizontal tiers in each case. The material can be further scaffold material or building material. The lift systems known from the state of the art are usually assembled separate from the scaffolding, for example in the form of a goods lift, with the result that the required material can be delivered in the vertical direction. As an alternative to the lift systems, cable winches are used which are partly mounted on the scaffolding, for example via their gear mechanism. The cable winches are likewise intended to transport the material to be transported in the vertical direction from the ground to a higher tier of the scaffolding.

The lift systems or cable winches are usually loaded at ground level by staff at a loading position in order to deliver the corresponding material to a higher tier of the scaffolding where the delivered material can be removed again at an unloading position, that is the lift system is unloaded. Staff are required for the loading and unloading, for example workers who load and unload the material. The unloaded material is then carried by the workers in the respective tier of the scaffolding to the place of use. Depending on the size of the scaffolding, several workers and possibly several lift systems are required in order to be able to transport the material efficiently from the unloading position to the place of use. This applies analogously to the transport of the material from a place of delivery, at which, for example, a heavy goods vehicle with the corresponding material to be transported is parked, to the loading position.

SUMMARY OF THE INVENTION

The object of the invention is to provide an efficient scaffold transport system with which it is possible to deliver, among other things, building material to the desired positions and locations on scaffolding efficiently, for example during the erection and dismantling of the scaffolding.

The object is achieved according to the invention by a scaffold transport system with a rail system, which has at least one horizontally running rail section, and at least one carriage module, which is designed to move along the rail system, wherein the carriage module has a coupling section via which the carriage module is captively and movably coupled to the rail system, and a carrier section by means of which the carriage module carries objects during the movement.

The fundamental idea of the invention is that, as a result of the horizontally running rail section, the scaffold transport system can transport objects, among other things, in a corresponding scaffold tier to the desired place of use efficiently and in an automated manner. For this it is no longer necessary to rely on the working power of staff, for example that of a worker, as a result of which the efficiency when transporting corresponding material can be increased. The efficiency is increased in that time-consuming and physically demanding tasks, that is the transporting of objects such as scaffolding material in a particular scaffold tier, are effected in an automated manner via the scaffold transport system. Manual intervention is no longer necessary. At the same time, transport safety is increased since a human error in the transporting of objects, for example of building and/or scaffold material, which could lead to damage to the corresponding objects or the surrounding area or to accidents involving people, is avoided. As a result of the increase in efficiency and the inherent improvement in safety, costs can be reduced at the same time since the effort and the time required can be reduced. The scaffold transport system can therefore result in improved building site logistics.

The scaffold transport system can be generally used in different scaffolds or types of scaffold, for example in tube and coupler scaffolds, working scaffolds, safety scaffolds, fixed scaffolds, suspended scaffolds, gantries, mobile scaffolds, facade scaffolds, birdcage scaffolds, stairtowers, free-standing scaffolds, industrial scaffolds, cable bridges, event staging and/or special designs, which are used among other things in civil engineering, in industrial plant construction, in road building, in bridge building, in vehicle construction, in shipbuilding, in structural engineering, in carpentry, in timber engineering, in specialist construction, in underground engineering, in earthworking, in land development, in hydraulic engineering and/or in specialist construction.

A scaffold is usually a temporary, re-usable auxiliary construction made of standardized scaffold elements, for example poles and/or tubes made of metal or wood, for example bamboo. Permanent scaffolds are also known, however, which are designed for permanent operation, for example in specialist or special construction or in specialized applications such as a tower scaffold.

One aspect provides that the rail system has at least one vertically running rail section, which is coupled to the horizontally running rail section. The carriage module can thus be moved along both rail sections. The two rail sections can intersect, wherein the carriage module is formed in such a way that it can pass over the intersection of the vertically running rail section and the horizontally running rail section. The manual transporting of building material or scaffold material from scaffold level to scaffold level can be simplified by this means since the time-consuming and physically demanding work is automated.

The vertically running rail section, which runs vertically along the scaffold starting from the base, can be installed first during the installation of the rail system. Starting from a loading position provided at the base of the scaffold, the rail system can then be extended. In particular, the first vertically running rail section first of all extends to the horizontally running rail section.

In general, the rail system has several vertically running rail sections as well as several horizontally running rail sections, with the result that the carriage module can reach as many positions in the rail system as possible in order to transport objects to the corresponding locations, for example the places of use. The several rail sections can intersect, whereby several intersections form at which the carriage module can change its direction of movement.

The at least one vertically running rail section and/or the at least one horizontally running rail section are or is in particular formed fixed in position. This means that the corresponding rail section is immovable.

The carriage module has, for example, a drive.

The drive ensures that the carriage module travels along the corresponding rail section automatically, thus is not pulled along the corresponding rail section either by a (hauling) cable or by a person.

In particular, the drive is integrated in the carriage module, thus arranged within a housing of the carriage module.

The drive can be an electric motor which converts electrical energy into a mechanical movement of the carriage module.

The energy supply of the drive can be guaranteed via at least one battery, for example an Li-ion battery. The battery is formed in particular as an accumulator.

According to a further aspect, the rail system has at least one two-dimensionally closed rail system area, in particular wherein several rail system areas are provided connected to each other. The rail system areas represent a two-dimensional rail network in which the carriage module can move. The rail system is therefore arranged in a plane which corresponds to the front of the corresponding scaffold. This plane is substantially perpendicular to the ground. The two-dimensional rail network is thus spread out in the vertical and horizontal direction, thus in the corresponding plane, with the result that the carriage module can move upwards, downwards, to the left and to the right in the closed, two-dimensional rail network.

The carriage module can be moved along a closed rail track of the rail system which at least comprises, in particular forms, the closed, two-dimensional rail network. The carriage module can approach a loading position and an unloading position, which are located along the closed rail track, in order to be loaded or unloaded.

A further aspect provides that the rail system comprises several modular rail elements, which can be fastened to a scaffold via fastening means, in particular by clip connections and/or plug-in connections, and/or the scaffold transport system comprises a scaffold which has scaffold elements, wherein the rail system is formed by the scaffold elements in each of which rail sections are integrated. The rail system can thus be built up from separately formed rail elements, which can be fastened to a scaffold, in particular retrospectively. The modular construction of the rail elements ensures that the rail system can be extended by adding further rail elements. In particular, the rail system can grow with the scaffold during the erection thereof, whereby it is guaranteed that all desired locations and positions of the scaffold can be reached. Since the separately formed rail elements can be coupled to existing, standardized scaffold elements, it is possible to retrofit the scaffold transport system.

The fastening means provided for attaching the rail elements can also have a modular formation, with the result that they can be fastened to the different fastening points of a scaffold in a simple manner. These can be snap connections or similar. Couplings usually used in scaffolding are also suitable, for example double couplers, swivel couplers and/or sleeve couplers. The fastening means can also be realized by tube and plug-in connections, screw or clamp connections, girder clamps and module node connections. The corresponding fastening means can be coupled to a coupling section of the scaffold, for example to usually used rosettes.

In general, all fastening and connecting means can be formed as the above-named couplers, clamps or connections.

According to another embodiment, the rail system is provided via the scaffold itself, which has correspondingly formed scaffold elements, which comprise in an integral manner rail sections required for the rail system. For example, the modular scaffold elements are poles or tubes which each form a corresponding rail section. When erecting the scaffold, the rail system is correspondingly extended at the same time.

In general, the rail elements can also comprise curved rail elements. The curved rail elements are provided, for example, to connect two rail sections, which intersect substantially at right angles and are running horizontally, to each other. The rail system can thus be extended using the curved rail elements such that the rail system is substantially L-shaped in top view. It is hereby possible, for example, for the rail system to extend over a scaffold erected along a building facade which has a corner. The L-shape of the rail system corresponds to two two-dimensional rail networks arranged substantially at right angles. The curved rail element ensures that the carriage module can move efficiently along the rail system since a right-angled connection of the two two-dimensional rail networks would at the least require the carriage module to stop completely. Due to the curved rail element, which is provided to connect the two two-dimensional rail networks intersecting each other substantially at right angles, the carriage module can change between the corresponding tiers which are formed by the rail networks without stopping completely. Using the curved rail elements, it is generally possible for the rail system to be formed three-dimensional, for example L-shaped.

The rail system can generally be formed such that it connects two rail sections, which intersect substantially at right angles and are running horizontally, to each other. This can be realized via at least one curved rail element or another transition mechanism.

The rail system can alternatively or additionally be formed such that it connects two rail sections, which intersect substantially at right angles and are running vertically in their corresponding two-dimensional rail network, to each other. For example, the carriage module travels along a vertically running rail section of a first rail network to the end thereof in order then to change to another two-dimensional rail network, which is perpendicular to the first. This is the case when the carriage module is moved upwards along a wall, wherein the wall represents the first two-dimensional rail network, in order then to travel further on a deck, which represents the second two-dimensional rail network perpendicular to the first. This transition can also be realized via at least one curved rail element or another transition mechanism.

In general, the rail elements or the scaffold elements having rail sections form movement paths for the at least one carriage module, along which the carriage module can move in order to transport objects.

The carrier section can have a modular formation such that different load-bearing units can be coupled to the carrier section. The load-bearing units can be load-bearing units specific to the object to be transported. If a large object is to be transported, a load-bearing unit formed specifically for this can be coupled to the corresponding carrier section, with the result that safe transport of the object is guaranteed. Correspondingly, several small objects can be safely transported in a different load-bearing unit, which can likewise be coupled to the carrier section. Due to the modular construction of the carrier section it is ensured that the different load-bearing units can be coupled to the carriage module in a simple manner. In addition, a load-bearing unit can be formed in such a way that several different objects can be transported with it. The modular formation of the carrier section ensures that the chosen load-bearing unit can be coupled to the corresponding carrier section of the carriage module in a simple manner and thus in a short time, whereby the efficiency of the scaffold transport system is correspondingly increased.

The objects to be transported along the rail system by the carriage module can be building material, scaffold material, people, tools and the like. For the different objects, correspondingly differently formed load-bearing units can be provided.

In general, the load-bearing units can be formed such that the objects to be transported are secured in the corresponding load-bearing units. This can be effected via corresponding locking or securing mechanisms, which the load-bearing units have.

According to an embodiment, the coupling section comprises at least one gripper unit, by means of which the carriage module is captively coupled to the rail system, and/or at least one sliding unit, by means of which the carriage module slides along the rail system. The gripper unit and the sliding unit can together form a grip-slide mechanism of the carriage module, via which the correspondingly safe movement of the carriage module along the rail system is possible. The gripper unit can be formed in such a way that it at least partially clasps the rail elements or sections of the rail system in order to be correspondingly captively coupled to the rail system. For this purpose, the gripper unit comprises a correspondingly formed clasping section.

The sliding unit can have a profile roll or a profile wheel, wherein the profile co-operates with correspondingly formed rail elements or sections. For example, the rail elements or sections have a repeating hole pattern, which corresponds to the profile of the sliding unit. The profile can comprise projections, which engage in the openings.

The sliding unit can be coupled to the drive, wherein the drive mechanically drives the sliding unit, in particular the profile roll or the profile wheel.

Alternatively, the sliding unit and the correspondingly formed rail elements or sections are formed by a rack-and-pinion drive system, in which the rail elements or sections are like toothed racks. Consequently, the rail elements or sections have regular projections with which the sliding unit co-operates, in particular the profile roll or the profile wheel of the sliding unit.

In general, the sliding unit and the rail elements or sections each have corresponding structures which can be provided on allocated surfaces.

The correspondingly formed structures of the sliding unit and of the rail elements or sections, for example the rack-and-pinion drive system, are provided for the vertically running rail elements or sections in particular. A vertical movement of the carriage module can hereby be ensured in a simple manner. The horizontally running rail elements or sections can also be formed correspondingly.

The movement of the carriage module along the horizontally running rail elements or sections can also be effected via rollers, tires or similar, which are also part of the sliding unit.

The grip-slide mechanism guarantees in particular that the carriage module can be coupled to the rail system in a simple manner. The carriage module can be fastened to a rail element of the rail system in a simple manner as a "plug-and-play" module, for example. For this purpose, the carriage module can be pressed onto the rail element via the gripper unit and/or the sliding unit, whereby the gripping mechanism of the gripper unit is activated. Alternatively or in addition, the gripping mechanism can be activated manually via a correspondingly formed button, via sensors or in another way.

In particular, the grip-slide mechanism and the corresponding gripper and sliding units ensure that the carriage module can pass over intersections of the rail system, at which vertically running rail sections and horizontally running rail sections intersect.

The gripper unit can comprise at least one length-adjustable arm, which has a free end on which a rolling element is provided. When the carriage module moves, the rolling element rolls on the rail element or section. The arm together with the rolling element guarantees that the rail element or the rail section is at least partially clasped.

In particular, the gripper unit comprises two arms with corresponding rolling elements.

The two arms can be allocated to opposite sides in relation to the respective rail element or the respective rail section, with the result that the respective rail element or the respective rail section is partially clasped from two opposite sides.

Alternatively or in addition, the two arms can be arranged in front and behind in the direction of movement of the carriage module, with the result that the carriage module always rests on one rail element or section with at least one rolling element when passing over intersecting rail sections. This guarantees that the carriage module is held captively.

In general, the at least one carriage module is thus held exclusively on at least one rail section, in particular the allocated rail element.

According to an embodiment, the carriage module comprises four gripper units, which are arranged in two pairs. The pairs define in each case a direction of movement of the carriage module, with the result that two directions of movement are provided, which intersect, in particular at right angles. One activated gripper unit is sufficient in order to guarantee the captive movement of the carriage module along the rail system.

Other embodiments can comprise fewer gripper units, for example two, or also more gripper units. This depends in particular on the field of application.

The carriage modules can comprise a direction-changing mechanism. The direction-changing mechanism can be formed by the grip-slide mechanism, thus the at least one gripper unit and the sliding unit, in particular the gripper units. For example, the carriage module is moved along the direction of a first pair until the carriage module is at the intersection of a horizontally running rail section and a vertically running rail section. In this position, at least one gripper unit of a second pair, which has previously not clasped the rail system, is activated with the result that the at least one gripper unit of the second pair at least partially clasps the rail system. Then, the active gripper unit of the first pair or the active gripper units of the first pair are released, with the result that the carriage module is only captively coupled to the rail system via the at least one gripper unit of the second pair. Then, the carriage module can be moved along the direction of movement which is defined by the second pair, that is perpendicular to the previous direction of movement.

In general, the speed of the carriage module can be reduced before a change in direction in order to ensure that the gripper units securely clasp the corresponding rail elements or sections.

Alternatively, it can be provided that the rail system has a direction-changing mechanism in which the intersections between horizontally and vertically running rail sections are formed by rotatably formed intersecting sections. Provided that a carriage module has reached an intersection or is at the corresponding intersecting section, the latter can be rotated (for example by 90°) in order to change the direction of movement of the carriage module. The intersecting sections can be correspondingly actuated by a system controller.

According to an embodiment, several carriage modules are provided. The several carriage modules can be moved simultaneously in the rail system, wherein they are spaced apart from each other, with the result that a safety distance is guaranteed. A collision between two carriage modules is thus effectively prevented. The individual carriage modules can carry different objects depending on which load-bearing unit is arranged on the corresponding carrier section of the carriage module. A continuous flow of material can hereby be achieved, since several carriage modules are moving simultaneously in the rail system with correspondingly loaded load-bearing units.

In particular, a system controller is provided, which is designed among other things to control the movement of the at least one carriage module along the rail system. The system controller can access sensor values in order to actuate an optimal movement of the at least one carriage module along the rail system. The sensor values are, for example, positions of people, who are carrying corresponding transmitters. The positions or locations to be actuated can hereby be determined by control systems. Furthermore, the rail elements can comprise sensors, which make it possible for the system controller to capture the constructed rail system. For example, the system controller generates a (two- or three-dimensional) model of the rail system in order to calculate optimized movement paths for the at least one carriage module. The rail system can also be stored by control systems using reference points, in that for example sensors or transmitters are provided at the intersections. Since linear movement paths are present between the intersections in each case, the system controller can determine these automatically or design the movement paths to be travelled along the reference points.

The sensors can be external sensors, which have been attached to the corresponding rail elements or at least have been allocated to the rail elements retrospectively.

The system controller can comprise a real-time position detection unit, which is designed to detect the positions of people, for example workers, and/or of carriage module(s) automatically. The system controller can accordingly coordinate the movements of the individual carriage modules automatically in order to prevent collisions or interference between the carriage modules and/or the workers. The calculations and implementations of the corresponding movement processes of the carriage modules can be effected automatically, with the result that the transport of the objects to be transported by the individual carriage modules to the corresponding places of use is guaranteed to be as efficient as possible.

The individual carriage modules can thus be formed as robots, the movement processes of which are controlled by the system controller. The system controller can function as a central system unit which actuates the carriage modules. Alternatively, the system controller can be formed by many individual control modules which are each integrated in a carriage module. The several control modules then together form the system controller, wherein they communicate with each other.

For example, the individual carriage modules each have an (integrated) control module which receives control commands and implements them appropriately.

Furthermore, the control modules of the individual carriage modules can be formed to generate the control commands.

The at least partially automated movement of the at least one carriage module along the rail system is effected hereby.

In general, the system controller can take into consideration safety protocols which are applied when the corresponding movement commands for the carriage modules are generated, thus the commands are generated for the carriage modules stipulating the movement paths of the rail system along which the carriage modules are to move. For example, the system controller comprises the prioritized safety protocol, according to which a sufficiently large safety distance must be maintained between the carriage modules and people, in particular workers, when the carriage modules are moving.

The system controller can furthermore comprise a collision detection system for unexpected objects in the movement paths, a remote emergency control, a sensor overload detection system and/or a manual intervention possibility, for example a switch to be operated manually in order to start or to stop the system.

The collision detection system is formed by sensors, for example infrared sensors and/or optical sensors, which are arranged on the respective carriage modules. The sensors capture corresponding data and transmit these to the system controller or to the system modules which are provided in the respective carriage modules.

The remote emergency control serves to stop the scaffold transport system in the case of an emergency. The remote emergency control can also be provided in order to send the individual carriage modules back to their previous positions. The previous positions are defined as the positions at which the carriage modules last stopped, usually loading and unloading positions.

The sensor overload detection system is provided, for example, via sensors correspondingly provided on the carriage modules which detect undesired operating states and accordingly transmit the captured data to the system controller. The sensors can be pressure, temperature, acceleration and/or gyro sensors.

In general, the carriage modules can comprise further sensors in addition to the named sensors.

In particular, the manual intervention possibility is available on each carriage module with the result that the operators, in particular workers, can control, stop and/or start the entire scaffold transport system when they operate the carriage module accordingly. This will usually be the case in the unloading and loading positions in which the carriage modules come to a halt.

In particular, the intervention possibility guarantees that the scaffold transport system, in particular the system controller, is notified that the corresponding carriage module has been loaded or unloaded, so that it can be moved.

The system controller can possess artificial intelligence or machine-learning technologies, so that it can learn automatically during operation.

For example, during operation, the scaffold transport system, in particular the at least one carriage module, collects data on the process of the erection of the scaffold, such as the quantity of transported weight, waiting times of at least one worker and/or of the at least one carriage module, type of activity, time required for loading or unloading the at least one carriage module, time required for transporting scaffold parts and inactive time, start of the working time and end of the working time, time and number of safety problems identified by the scaffold transport system, in particular the system controller, and further data generated by sensors and from the interaction of the carriage module with the workers.

Furthermore, the scaffold transport system can comprise a sensor, for example a visual, ultrasound-based or other type of sensor, which is designed to recognize scaffold parts, with the result that the scaffold transport system is designed to count the number of scaffold parts used, in particular depending on the respective type.

The workers who work with the scaffold transport system can be equipped with a portable device so that steps, elevation and further data are captured and/or recorded. The data can be synchronized with the at least one carriage module.

All of the (captured) data can be stored in a data-processing unit, for example a cloud server. Through this the data can be presented to the operator of the scaffold transport system in an edited manner, for example on a website.

As an alternative or in addition to the at least one carriage module, the data can be synchronized with the data-processing unit, for example the cloud server.

Furthermore, the invention is achieved by a method for controlling a scaffold transport system with a rail system, which has at least one horizontally running rail section, and at least one carriage module, with the following steps:

Loading the carriage module in a loading position,

Moving the carriage module along the rail system, and

Unloading the carriage module in an unloading position.

It is thus possible to transport objects efficiently and in an automated manner with the carriage module in a horizontal plane, for example a tier of scaffolding, when the carriage module is moved along the horizontally running rail section. The rail system is formed by the scaffold or at least fastened to the scaffold.

If, in addition to the horizontal rail section, the rail system comprises at least one vertically running rail section, it is furthermore possible to move the carriage module in a movement plane which is perpendicular to a horizontal plane. The carriage module can therefore move objects along the scaffold, that is in a horizontal and in a vertical direction.

The rail system can furthermore have a two-dimensionally closed rail system area, whereby it is possible to load and unload the at least one carriage module in a repeating process. In the case of the closed rail system area it is possible in particular to use several carriage modules, with the result that objects can be transported from the loading position to the unloading position at an increased pace. The efficiency of the scaffold transport system is correspondingly increased.

Furthermore, several unloading and loading positions can be provided in the rail system, wherein the corresponding carriage modules can be actuated by the system controller to approach the corresponding positions. The unloading and loading positions can be defined by stopping positions for the carriage module along the rail tracks comprised by the rail system. Alternatively, the carriage modules can also be directed manually to approach the corresponding positions.

The object of the invention is furthermore achieved by the use of a scaffold transport system of the type named above and/or the use of a method of the type named above for erecting and/or dismantling a scaffold. The erection and dismantling of a scaffold are thus effected efficiently and with a high degree of automation, whereby the costs can be correspondingly reduced.

The scaffold transport system can consequently be used to deliver scaffold material, for example scaffold elements, fastening means and further building material for the scaffolding, to the required points during the erection or dismantling of the scaffold. At the same time, the scaffold transport system can be used to extend or dismantle the corresponding scaffold transport system, since this has a modular construction.

The scaffold transport system is extended or dismantled in a simple manner if the scaffold elements already comprise integrated rail sections, since the rail system is then extended or dismantled at the same time as the scaffold is erected or dismantled.

BRIEF DESCRIPTION OF THE DRAWINGS

Further advantages and properties of the invention emerge from the following description and the drawings, to which reference is made. The following is shown in the drawings.

DETAILED DESCRIPTION OF THE INVENTION

Figure 1:
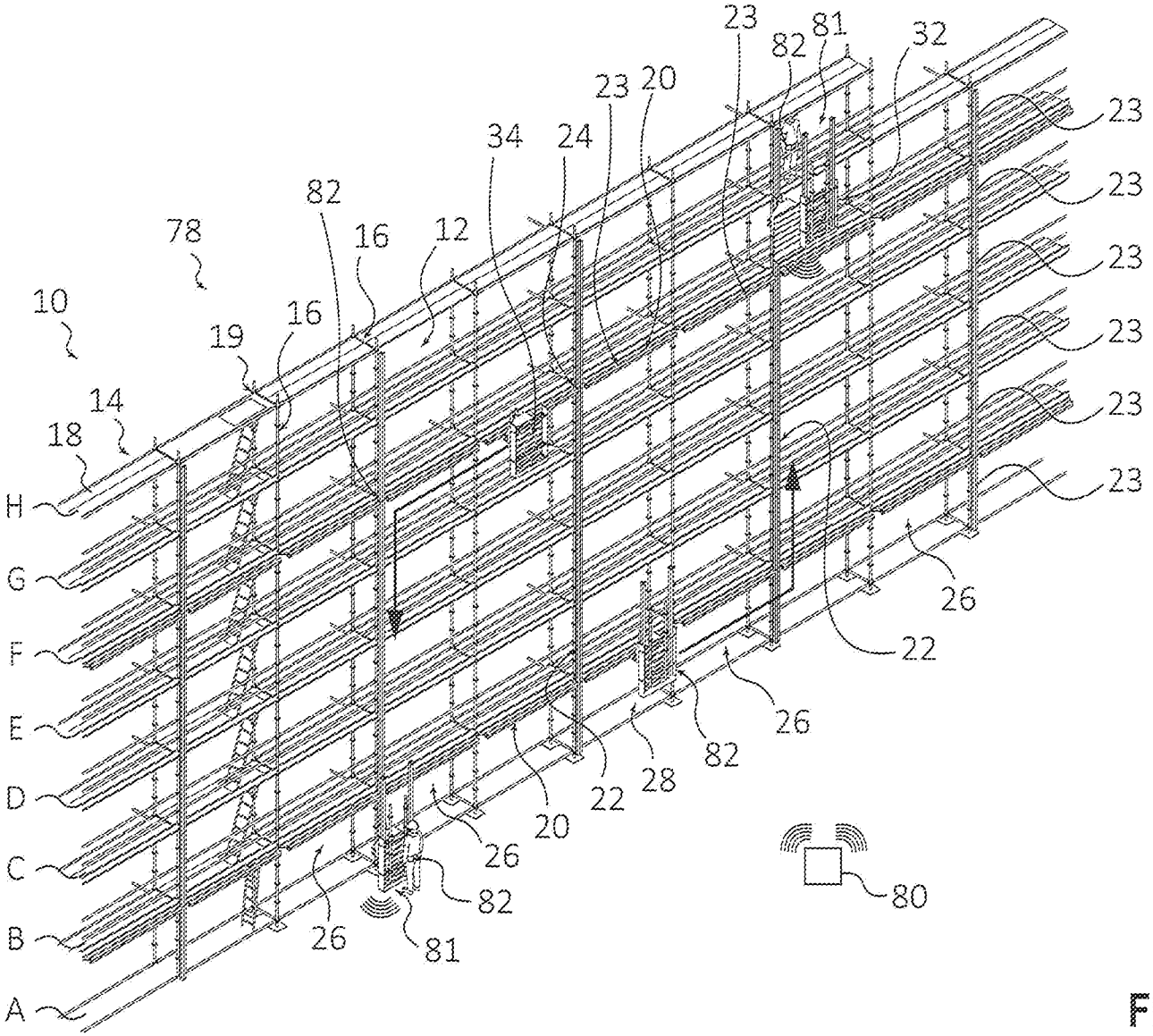
FIG. 1 a schematic perspective view of a scaffold transport system according to the invention according to a first embodiment, FIGS. 2*a* to 2*c* a vertically running rail element in various views, FIGS. 3*a* and 3*b* a horizontally running rail element in various views, FIG. 4 a carriage module coupled onto a vertically running rail element, FIG. 5 a carriage module coupled onto a horizontally running rail element, FIG. 6 an exploded view of a carriage module with a coupled-on load-bearing unit arranged on a vertically running rail element, FIGS. 7*a* to 7*f* the load-bearing unit shown in FIG. 6 in various states, FIG. 8 a schematic perspective view of a scaffold transport system according to the invention according to a second embodiment, FIG. 9 a section of a schematic perspective view of a scaffold transport system according to the invention according to a third embodiment, FIG. 10 a section of a schematic perspective view of a scaffold transport system according to the invention, and FIG. 11 a perspective view of a further scaffold transport system.

In FIG. 1, a scaffold transport system 10 is shown, which comprises a rail system 12, which in the embodiment shown is arranged on scaffolding 14, which comprises several tiers A to H, which extend in a horizontal plane parallel to the base. Therefore, the scaffolding 14 has a base A as well as seven further tiers of scaffolding B to H.

The scaffolding 14 corresponds to conventional scaffolding, which is formed by several scaffold elements 16, for example tubes or pole ledgers, standards, diagonal braces, board surfaces 18, which form the corresponding tiers B to H, as well as connecting elements 19, via which the board surfaces 18 and/or the scaffold elements 16 are connected to each other, in order to form the scaffolding 14. The connecting elements 19 can be wedge connectors.

In the embodiment shown, the rail system 12 comprises several horizontally running rail sections 20 as well as several vertically running rail sections 22, which are formed by modular rail elements 23, which are coupled to the scaffolding 14, in particular the scaffold elements 16, as will be explained below. The rail elements 23 are therefore formed separate from the scaffolding 14.

In the embodiment shown, a horizontally running rail section 20 is provided in scaffolding tier B, and in scaffolding tier F a further horizontally running rail section 20 is provided, such that four tiers of scaffolding B to F lie between the two horizontally running rail sections.

In contrast, the vertically running rail sections 22 are provided in each case at intervals of two vertically running scaffold elements 16, as follows from FIG. 1. However, the intervals can also be chosen differently, depending on need.

The respective vertically running rail sections 22 and the horizontally running rail sections 20 are coupled to each other in each case, with the result that intersections 24 of the corresponding rail system 12 form, which will be discussed below.

Furthermore, two vertically running partial rail sections and two horizontally running partial rail sections, which connect the two vertically running partial rail sections to each other, form a two-dimensionally closed rail system area 26, which, in a front view of the scaffolding 14, partially covers a plane of the scaffolding 14 which extends in the horizontal and the vertical direction. The vertically running partial rail sections are each formed by four rail elements 23, whereas the horizontally running partial rail sections are each formed by two rail elements 23.

In the embodiment shown, several interconnected rail system areas 26 are provided, which are arranged adjacent to each other and connected to each other. The adjacent rail system areas 26 are connected in that they share a horizontally running partial rail section and a vertically running partial rail section.

In total, four different rail system areas 26 are provided in FIG. 1.

The rail sections 20, 22, in particular the rail elements 23, are all formed fixed in position with the result that the rail system 12 is fixed.

In addition to the rail system 12, the scaffold transport system 10 comprises at least one carriage module 28, which is designed to move along the rail system 12, as will be explained below, in particular with reference to FIGS. 4 to 7.

Figure 4:
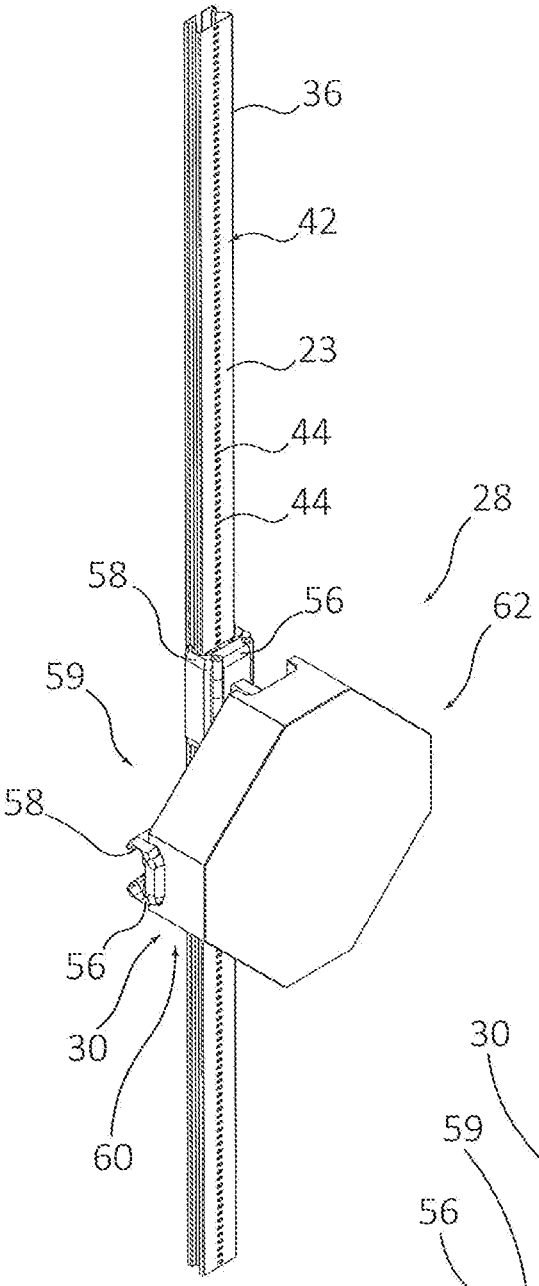
Figure 5:
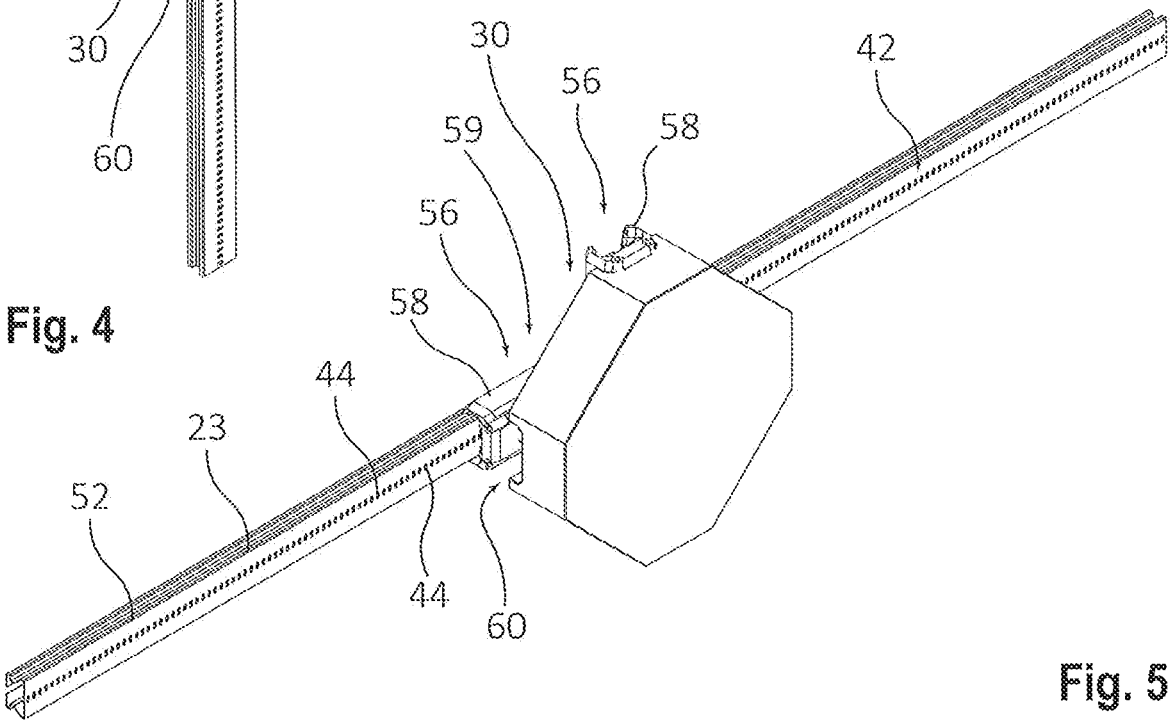
Figure 6:
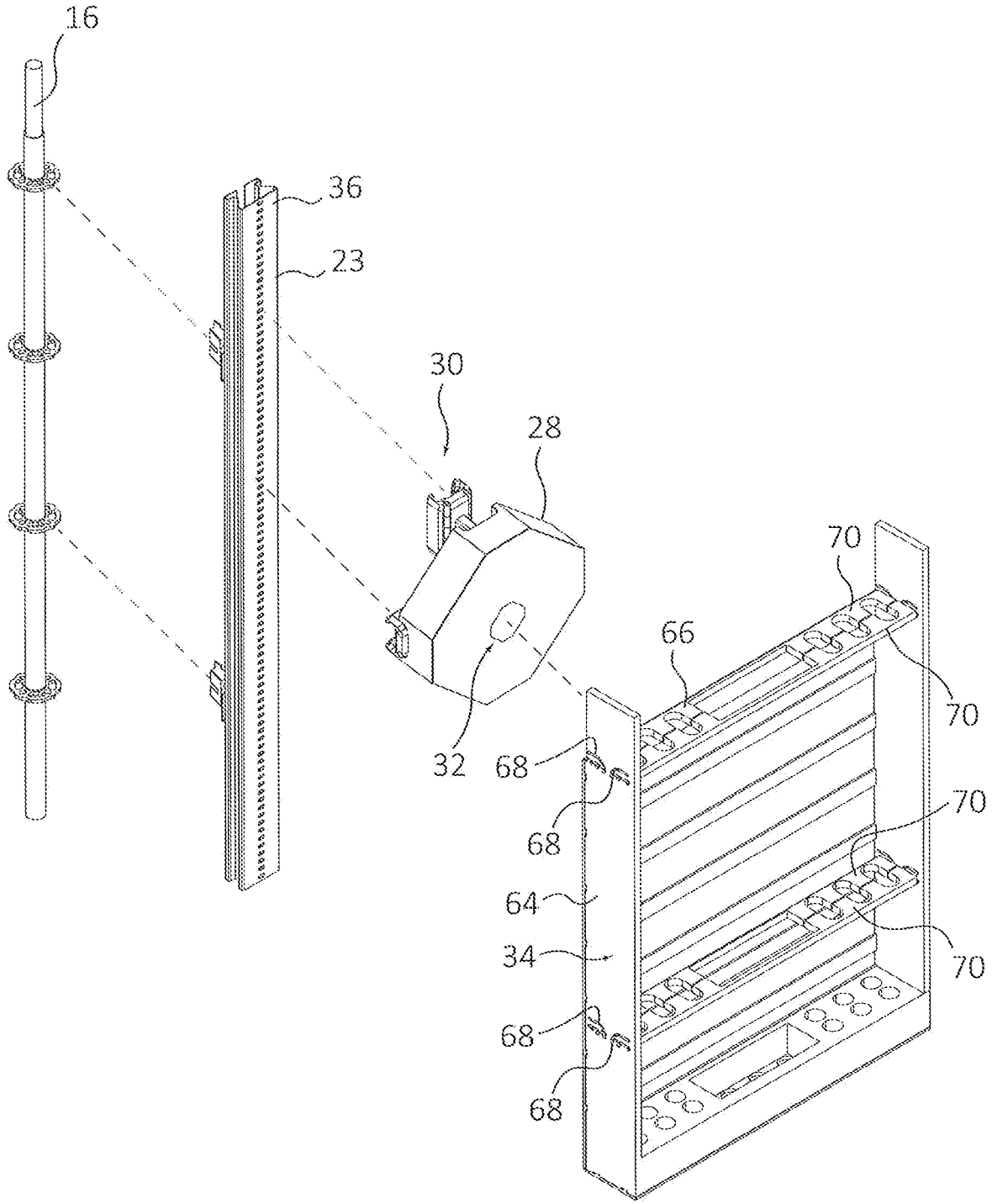

For this purpose, the carriage module 28 has a coupling section 30 via which the carriage module 28 is captively and movably coupled to the rail system 12 during operation (see in particular FIGS. 4 to 6). In addition, the carriage module 28 comprises a carrier section 32, by means of which the carriage module 28 can carry objects, as clearly follows from FIG. 1. For this purpose, a load-bearing unit 34 is coupled to the carrier section 32, which is explained in more detail below with reference to FIGS. 6 and 7.

In FIG. 1, in total four carriage modules 28 are shown, which belong to the scaffold transport system 10. Consequently, at least one carriage module 28 is allocated to each rail system area 26.

In general, several carriage modules 28 can be provided for each rail system area 26, with the result that an increased pace results in a corresponding rail system area 26. This will be explained in more detail below with reference to the controller of the scaffold transport system 10.

The carriage modules 28 can also be moved over several rail system areas 26, thus one carriage module 28 for several rail system areas 26.

In general, the horizontally running rail sections 20 and the vertically running rail sections 22 define several movement paths for the carriage modules 28, along which the carriage modules 28 can move.

Figure 2A:
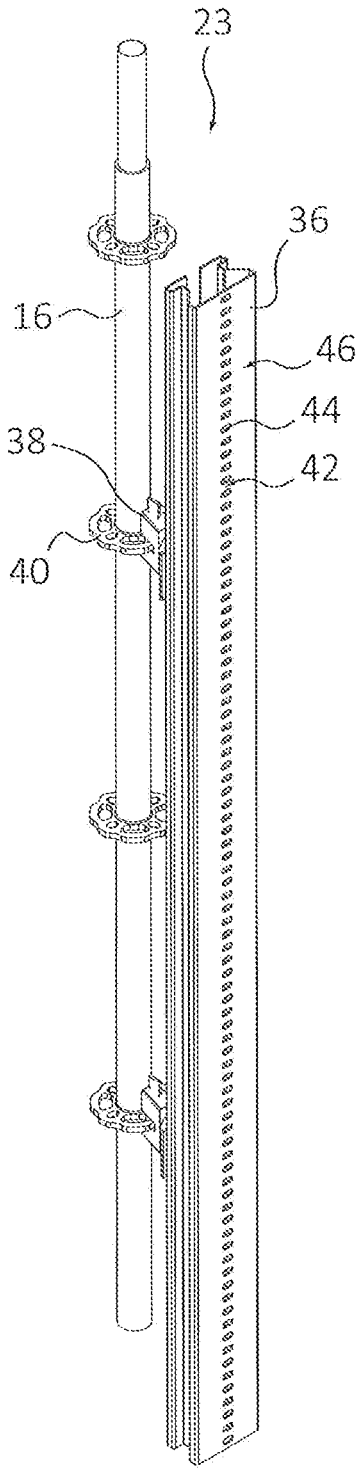
Figure 2B:
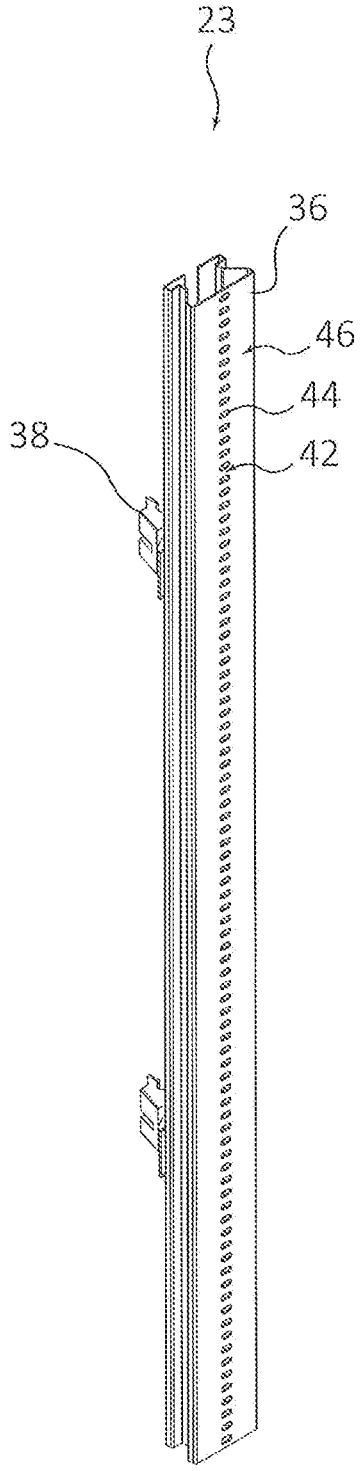
Figure 2C:
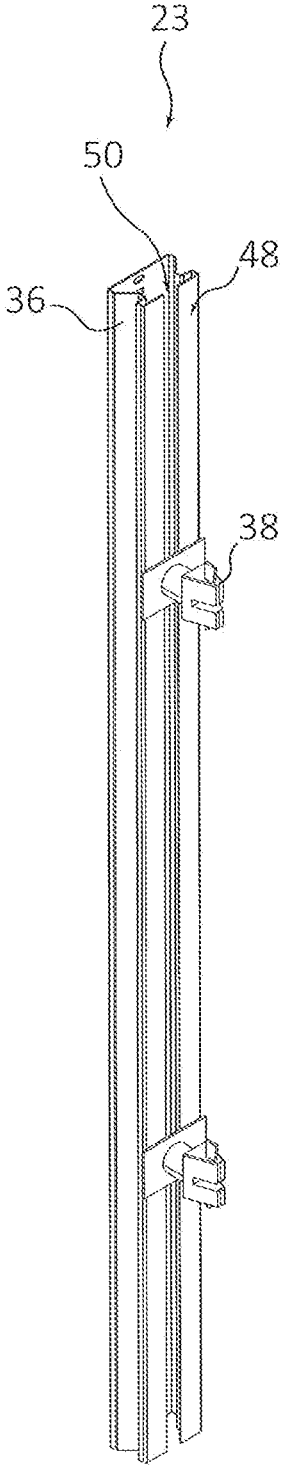

In FIGS. 2*a* to 2*c*, a part of the rail system 12 is shown in more detail, namely a rail element 23. The rail element 23 shown is a vertically running rail element 36, which is shown in various views.

In a simple embodiment of the scaffold transport system 10, such a vertically running rail element 36 can already form a vertically running rail section 22. However, several vertically running rail elements 36 are usually provided in order to form a vertically running rail section 22, as follows from FIG. 1.

The vertically running rail element 36 is formed separate from the vertically running scaffold element 16, as follows from FIG. 2*a*. It is coupled to the vertically running scaffold element 16 via fastening means 38, in particular at a coupling section 40 attached to the scaffold element 16, for example at a so-called rosette. The coupling section 40, in particular the rosette, can be welded to the scaffold element 16, thus be fixed in terms of position.

The corresponding fastening means 38 can be clearly seen in FIG. 2*c*. From this it follows that the fastening means 38 can be formed as a clip or plug-in connection, which has a modular formation, with the result that it can be coupled to the corresponding coupling section 40 quickly and easily.

The fastening means 38 comprises in particular a wedge-shaped fastening section, which has a slot via which the fastening means 38 can be pushed onto the coupling section 40, in particular the rosette. In the fastening section, a fastening mechanism can be provided, which deploys automatically in order to couple the fastening means 38 to the coupling section 40 when the fastening section has been pushed onto the coupling section 40 via the slot. In this case a bolt, for example, is guided through a receiving area of the coupling section 40 in order to lock the fastening means 38 to the coupling section 40. The receiving area is one of the corresponding openings of the coupling section 40, that is the rosette.

The fastening means 38 is, for example, a modular scaffolding wedge connector.

As follows in particular from FIGS. 2*a* and 2*b*, the vertically running rail element 36 comprises a travel section 42, which is formed by means of regular openings 44 in a surface 46 of the corresponding vertically running rail element 36. The openings 44 are arranged periodically at regular intervals, wherein they co-operate with the coupling section 30 of the carriage module 28, as will be explained.

In general, the vertically running rail element 36 can be made from a metal sheet which has been bent, for example using a (CNC) bending machine. The metal sheet can be a steel sheet, in order to provide the required rigidity. The thickness of the metal sheet can be between 2 mm and 4 mm, in particular 3 mm.

As follows from FIGS. 2*a* to 2*c*, the corresponding vertically running rail element 36 substantially has a Ω shape, wherein the upper continuous section, which defines the travel section 42, is formed flat, with the result that the carriage module 28 can move along the travel section 42. In addition, the free ends are bent over again compared with a true Ω shape, in particular twice, with the result that they point towards the opening of the "Ω". Because of the shape of the rail element 36, a high flexural strength is guaranteed with low material usage, with the result that the respective rail element 36 is light but resistant to bending.

As follows in particular from FIG. 2*c*, on its rear side 48 the vertically running rail element 36 has a substantially continuous slot 50, by means of which the respective modular fastening means 38 can be inserted and displaced in the vertically running rail element 36. The respective fastening means 38 can thus be displaced along the slot 50 in order to be matched to the position of the usually fixedly arranged coupling sections 40 of the vertically running scaffold elements 16. This guarantees a correspondingly simple installation of the rail system 12.

The fastening means 38 can be selected depending on the erected scaffold, in particular the type of scaffold, and correspondingly coupled to the vertically running rail element 36. For this purpose, it is inserted and pushed to the corresponding position. Then it is fixed such that it is fastened to the rail element 36.

The positions of the fastening means 38 can then be fixed accordingly, using fixing means or fixing mechanisms, in order to prevent an undesired relative movement.

The length of the vertically running rail element 36 can be 0.5 m, 1 m, 1.5 m, 2 m, 2.5 m, 3 m, 4 m or more, wherein the corresponding length is matched to the lengths of the vertically running scaffold elements 16 usually used, which are standardized. Intermediate lengths or shorter vertically running rail elements 36 can accordingly also be provided.

Figure 3A:
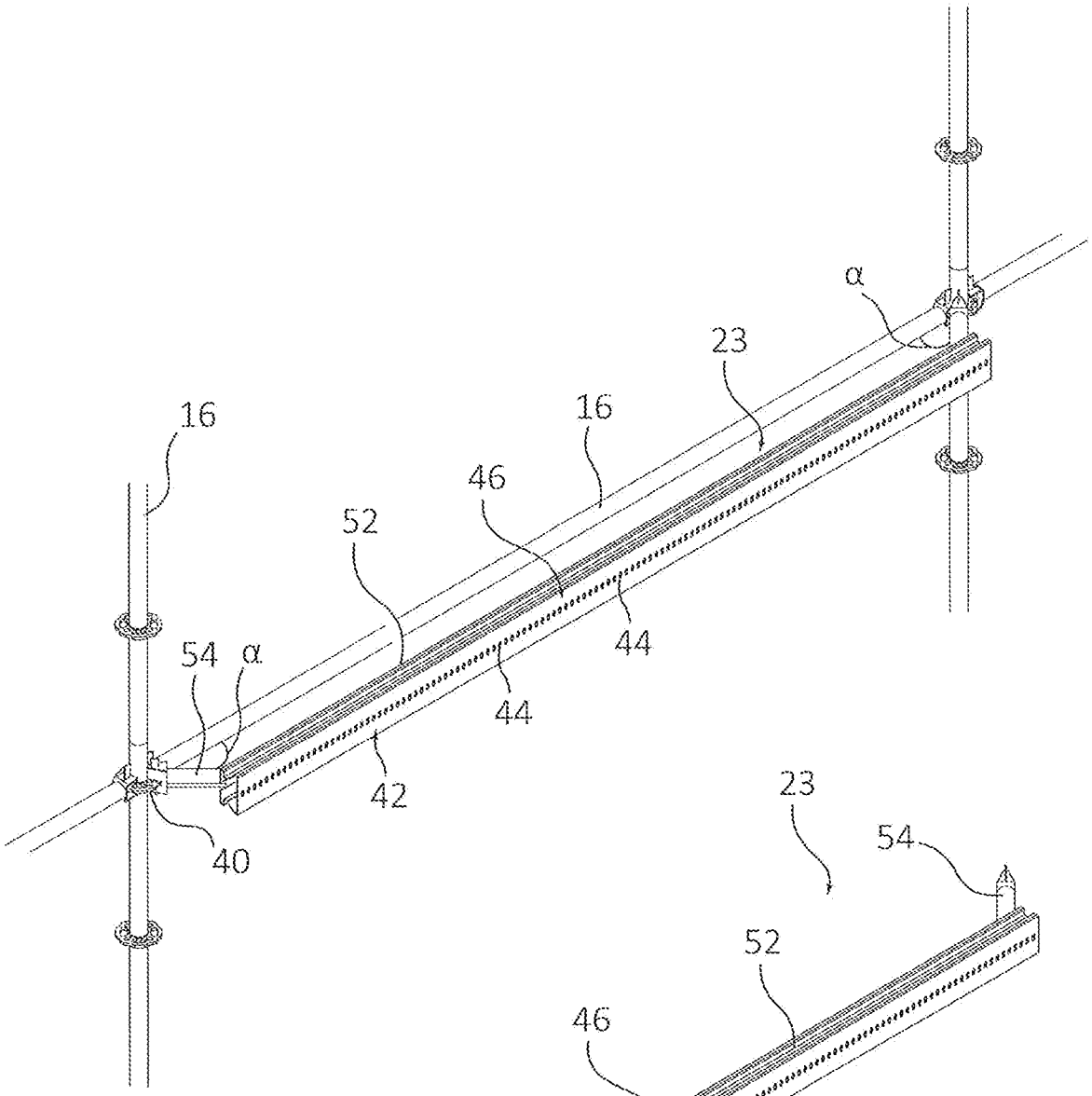
Figure 3B:
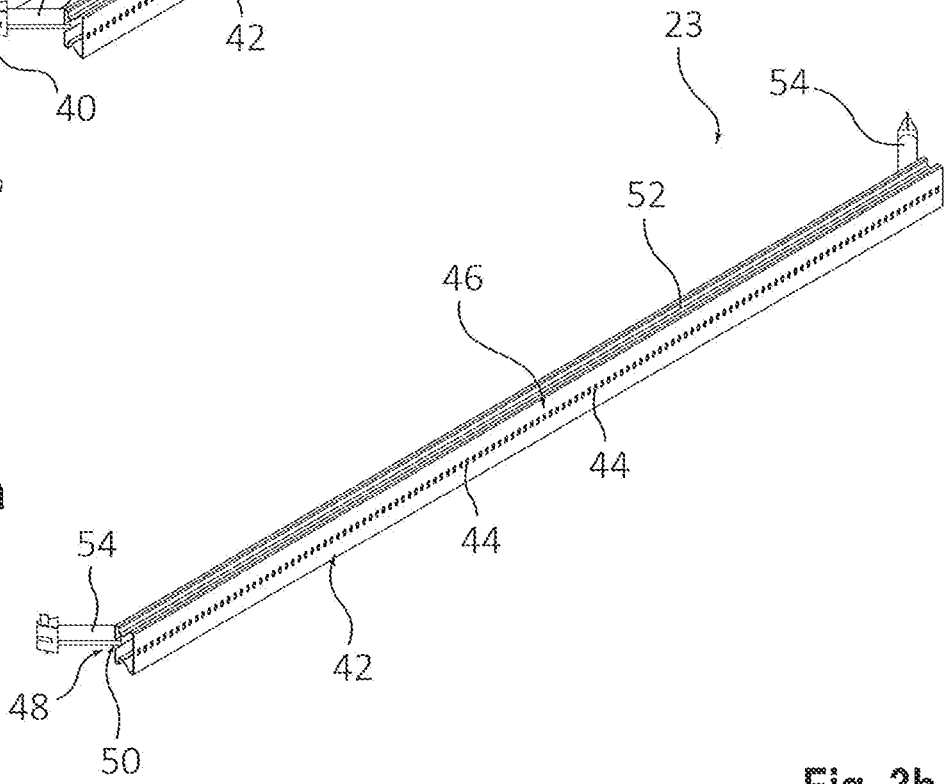

In FIGS. 3*a* and 3*b*, a further rail element 23 used in the rail system 12 is shown, namely a horizontally running rail element 52, which is formed substantially in an analogous manner to the vertically running rail element 36.

In the embodiment shown, the horizontally running rail element 52 differs only in the type of connection to the scaffolding 14, in particular the scaffold elements 16. Fastening means 54 are likewise provided, by means of which the horizontally running rail element 52 is coupled to the corresponding coupling sections 40, for example the rosettes, of the vertically running scaffold elements 16.

In some embodiments, the fastening means 54 and the coupling sections 40 of the scaffold elements 16 can represent a sleeve connection.

The fastening means 54 for the horizontally running rail element 52 extend from the corresponding coupling section 40 in each case at an angle $\alpha$, wherein the angle $\alpha$ to the horizontally running scaffold element 16, relative to which the horizontally running rail element 52 is to be arranged in parallel, is between 10° and 90°, in particular approximately 45°.

In the embodiment shown, the horizontally running rail element 52 is formed shorter than the corresponding horizontally running scaffold element 16.

Apart from that, like the vertically running rail element 36, the horizontally running rail element 52 substantially has a Ω shape, wherein a travel section 42 is provided with regular openings 44 on a surface 46 of the horizontally running rail element 52. Likewise, on its rear side 48 the horizontally running rail element 52 has a substantially continuous slot 50, by means of which the position of the fastening means 54 can be adjusted.

The scaffold transport system 10 represented in FIG. 1, in particular the rail system 12 thereof, shows how the individual rail elements 23 are arranged on the scaffolding 14, that is the vertically running rail elements 36 and the horizontally running rail elements 52.

In FIGS. 4 and 5 it is shown in detail how the carriage module 28 is arranged on a rail element 23, in particular a vertically running rail element 36 (see FIG. 4) and a horizontally running rail element 52 (see FIG. 5).

As already explained, the carriage module 28 comprises a coupling section 30, which is formed, in the embodiment shown, by four separately formed gripper units 56, of which however only two gripper units 56 are shown in the figures. The four gripper units 56 are in each case arranged opposite each other in pairs on the carriage module 28, with the result that each carriage module 28 comprises two gripper units 56 which are arranged in the direction of movement during operation, as well as two further gripper units 56 which are arranged perpendicular to the direction of movement.

During operation, the carriage module 28 is permanently coupled to the corresponding rail element 23 with at least one gripper unit 56, with the result that the carriage module 28 is captively arranged on the rail system 12. The corresponding gripper units 56 ensure that the carriage module 28 is nevertheless arranged movable, since they only at least partially clasp the corresponding rail element 23. The gripper units 56 in particular have a clasping section 58 corresponding to the Ω shape of the rail elements 23, that is a bracket-like grip.

The clasping section 58 engages, for example, in a recess in the substantially Ω-shaped rail elements 23, with the result that the carriage module 28 is guided securely.

The four gripper units 56 ensure that for one thing the carriage module 28 can pass over the intersections 24 of the rail system 12 and at the same time can change direction at the corresponding intersection 24.

In this respect, the four gripper units 56 form a gripping mechanism and a direction-changing mechanism 59, which is explained below with reference to FIG. 1.

From FIG. 1 it follows that the vertically running rail sections 22 are formed continuous, which means that the carriage module 28 can be moved without braking along a corresponding vertically running rail section 22, since there are no interruptions.

If the carriage module 28 is to be moved in the horizontal direction over a vertically running rail section 22, the carriage module 28 encounters an interruption. Because of the formation of the gripper units 56 in pairs it is ensured that gaps or interruptions can be passed over, with the result that the carriage module 28 can nevertheless be moved without braking. The gap or interruption to be bridged depends on the size of the carriage module 28, in particular the spacing of the gripper units 56 of a pair.

The use of the direction-changing mechanism 59 is explained below. By way of example, a carriage module 28 moves along a vertically running rail section 22 towards an intersection 24, at which the carriage module 28 is to change its direction of movement from a vertical movement into a horizontal movement.

The gripper unit 56 at the front in the direction of movement can be released so that the carriage module 28 is coupled to the corresponding vertically running rail element 36 only by means of the gripper unit 56 at the rear in the direction of movement. The carriage module 28 is then moved onto the intersection 24, with the result that the two gripper units 56 provided for the vertical movement are allocated to different vertical rail elements 36 of the rail system 12.

Alternatively, the carriage module 28 is driven onto the intersection 24 without releasing one of the two gripper units 56, since the corresponding interruption or gap can be passed over by the carriage module 28.

In this position, in which the carriage module 28 is located on the intersection 24, the two gripper units 56 provided for the horizontal movement are likewise allocated to two different horizontally running rail elements 52. However, both gripper units 56 provided for the horizontal movement are still in the inactive state.

Depending on the further horizontal movement (to the left or right), at least one corresponding gripper unit 56 provided for the horizontal movement is actuated in order to engage with the corresponding horizontally running rail element 52, whereby in the meantime the carriage module 28 is coupled both to at least one horizontally running rail element 52 and to at least one vertically running rail element 36.

Then, all of the gripper units 56 provided for the vertical movement are released, with the result that the carriage module 28 is coupled to the rail system 12 only by means of at least one gripper unit 56 provided for the horizontal movement. Then, the carriage module 28 can be moved in the horizontal direction along the horizontally running rail element 52.

In general, it can be provided that, during the movement, the carriage module 28 is coupled onto the corresponding rail element 23 by means of one or two gripper units 56.

In addition to the gripper units 56, the respective coupling section 30 of a carriage module 28 comprises a sliding unit 60 by means of which the carriage module 28 is moved along the rail elements 23.

The corresponding sliding unit 60 interacts with the openings 44 of the travel section 42 (see FIGS. 2 and 3), wherein the sliding unit 60 comprises, for example, a profile roll or a profile wheel, wherein the corresponding profile has projections corresponding to the openings 44, which engage in the openings 44 when the carriage module 28 is moved along the rail elements 23.

The sliding unit 60 can be coupled to a drive that is integrated in the carriage module 28 which drives the sliding unit 60, in particular the profile roll or the profile wheel. The drive is located in the housing of the carriage module 28, which is why it cannot be seen in the figures.

The gripper units 56 and the sliding unit 60 together therefore represent a grip-slide mechanism 62 of the carriage module 28. The coupling section 30 consequently comprises a direction-changing mechanism 59 and a grip-slide mechanism 62.

According to a particular embodiment, a combined grip-slide mechanism 62 can be formed, with the result that the sliding function is integrated, for example, in the corresponding gripper units 56.

In general, the rail elements 23, which form the vertically running rail sections 22 and the horizontally running rail sections 20, can be connected to each other at the intersections 24. The carriage modules 28 then have a correspondingly formed grip-slide mechanism 62, which makes it possible for the carriage modules 28 to be able to pass over such intersections 24 and to be able to change their direction of movement there.

The particular grip-slide mechanism 62 can be implemented by a defined actuation sequence of the gripper units 56.

In FIG. 6, an exploded view of a carriage module 28 arranged on a vertically running rail element 36 is represented, with a load-bearing unit 34 being coupled to the schematically represented carrier section 32 thereof.

The carrier section 32 has a modular formation, with the result that different load-bearing units 34 can be coupled to the carrier section 32. For example, it can be a clip or clamp connection, with the result that the corresponding load-bearing unit 34 is coupled to the carriage module 28, in particular the carrier section 32 thereof, using pressure.

The load-bearing unit 34 shown comprises a supporting frame 64 as well as a core 66 arranged in the supporting frame 64, which is suitable for receiving different objects. This follows clearly from FIGS. 7*a* to 7*f*, in which the construction of the load-bearing unit 34 is shown more precisely.

For example, it follows from FIGS. 7*e* and 7*f* that the core 66 can be pushed onto the corresponding supporting frame 64. Depending on the design, this can be effected from the left or the right side, or from both sides.

The supporting frame 64 of the load-bearing unit 34 is correspondingly coupled directly to the carrier section 32 of the carriage module 28 in a modular manner. In addition, the supporting frame 64 itself can likewise have a modular formation, with the result that different cores 66 can be inserted in the supporting frame 64.

The core 66 shown in FIG. 7 is formed such that it can receive scaffold elements 16 usual for scaffolding, in order to produce a further element of the scaffolding 14. The core 66 is designed to receive at least four horizontally running scaffold elements 16, two board surfaces 18 as well as two vertically running scaffold elements 16, as is represented. In general, the core 66 can receive more objects however.

In addition, the core 66 comprises a securing mechanism 68, by means of which the objects, for example scaffold elements 16, introduced into the load-bearing unit 34, in particular the core 66, can be secured accordingly. This ensures that the objects to be transported cannot become detached from the carriage module 28 and fall down.

In the embodiment shown, the securing mechanism 68 is formed by a flap mechanism and retaining elements 70 coupled thereto, which can be operated on the outer sides of the core 66. In this way, the retaining elements 70 can be displaced in order to be transferred into a receiving position in which the core 66 can be loaded; see FIG. 7*b* in particular.

In general, a load-bearing unit 34 with which people can also be conveyed can be arranged on the carrier section 32 of the carriage module 28. The correspondingly formed load-bearing unit 34 therefore has a basket or similar with which people can be transported.

Figure 8:
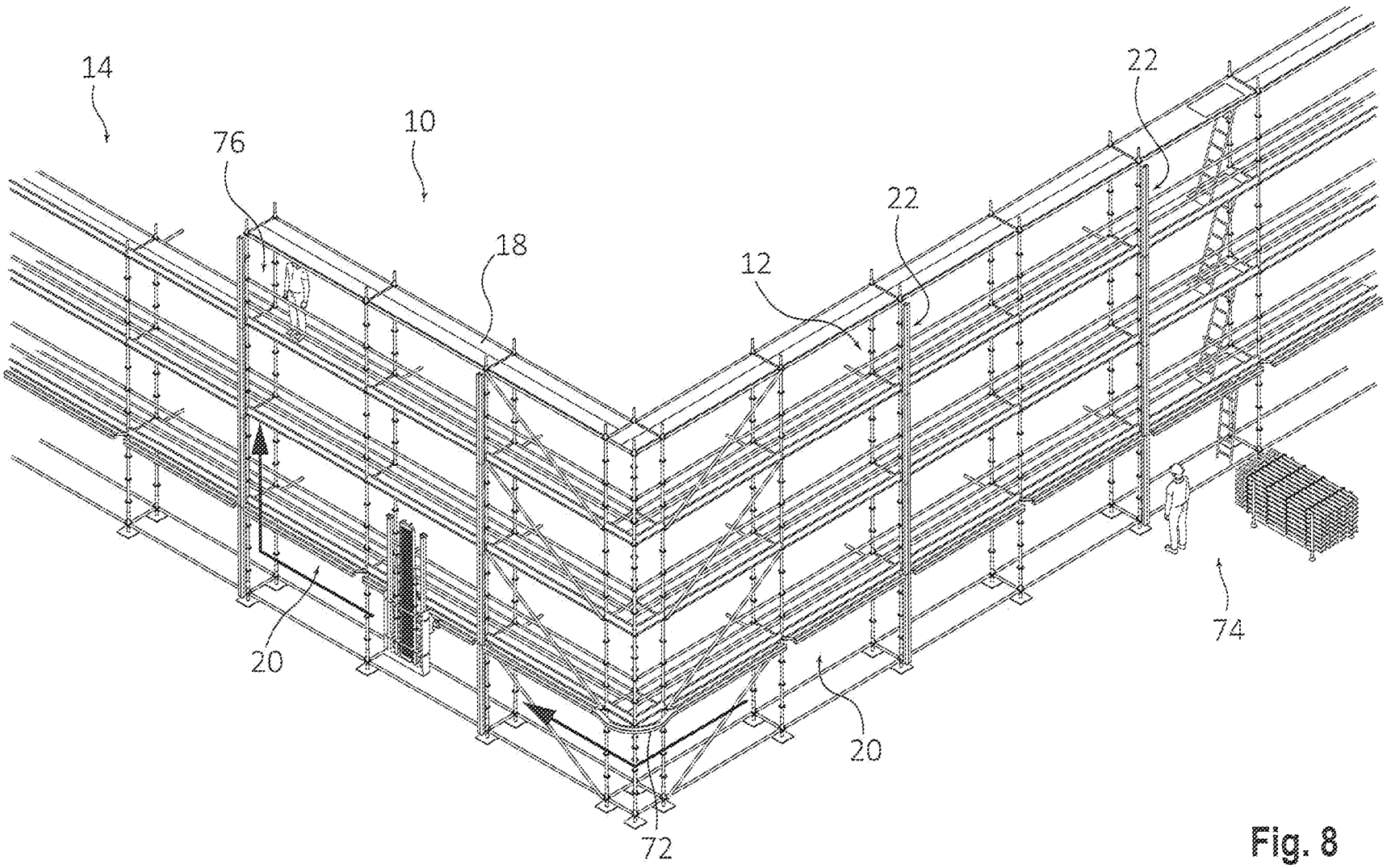

In FIG. 8, an alternative embodiment of a scaffold transport system 10 according to the invention is shown, which substantially corresponds to that from FIG. 1.

The scaffold transport system 10 shown in FIG. 8 comprises at least one further horizontally running rail section 20, which runs substantially perpendicular to the horizontally running rail sections 20 shown in FIG. 1, thus in a third plane additional to the plane of the scaffold transport system 10 constructed by FIG. 1.

The at least one further horizontally running rail section 20 is connected to the other horizontally running rail section 20 by means of a curved rail element 72, which extends over a corner of the scaffolding 14.

By this means, the scaffold transport system 10 and the rail system 12 are formed three-dimensional, since two two-dimensional rail networks, which are substantially perpendicular to each other, are coupled to each other by means of the curved rail element 72. The rail system 12 shown in FIG. 1 is therefore a two-dimensional rail network. The correspondingly constructed rail networks each represent a rail plane, which is spanned by the horizontal and vertical direction, which corresponds to the front of the scaffold 14.

In the embodiment shown, the two two-dimensional rail networks do not yet have any two-dimensionally closed rail system areas 26 since only one horizontally running rail section 20 is provided for each rail network.

However, in each case a further horizontally running rail section 20 can be installed in the upper scaffolding tiers in order to form two-dimensionally closed rail system areas 26, with the result that rail system areas 26 of the rail system 12 adjacent to each other at corners are then coupled to each other by means of the curved rail element 72. The two two-dimensional rail networks can consequently be connected to each other by means of the curved rail element 72 in order to form the three-dimensional rail system 12.

As follows from FIG. 8, in particular the drawn-in arrows, it is possible for at least one carriage module 28 to move over both two-dimensional rail networks, with the result that the carriage module can also be moved around curves or corners of the scaffolding 14. By this means, material can thus be transported in an automated manner over long distances, in particular over corners of a building.

To erect scaffolding 14 of this type, only two workers are therefore necessary, as is shown in FIG. 8, namely one at a loading position 74 and another at an unloading position 76 of the rail system 12. This applies analogously to the construction in FIG. 1.

At the corresponding positions 74, 76, the carriage module 28 is loaded or unloaded, wherein the carriage module 28 is moved between the two positions 74, 76 along the rail system 12, in particular along the curved rail element 72.

Figure 9:
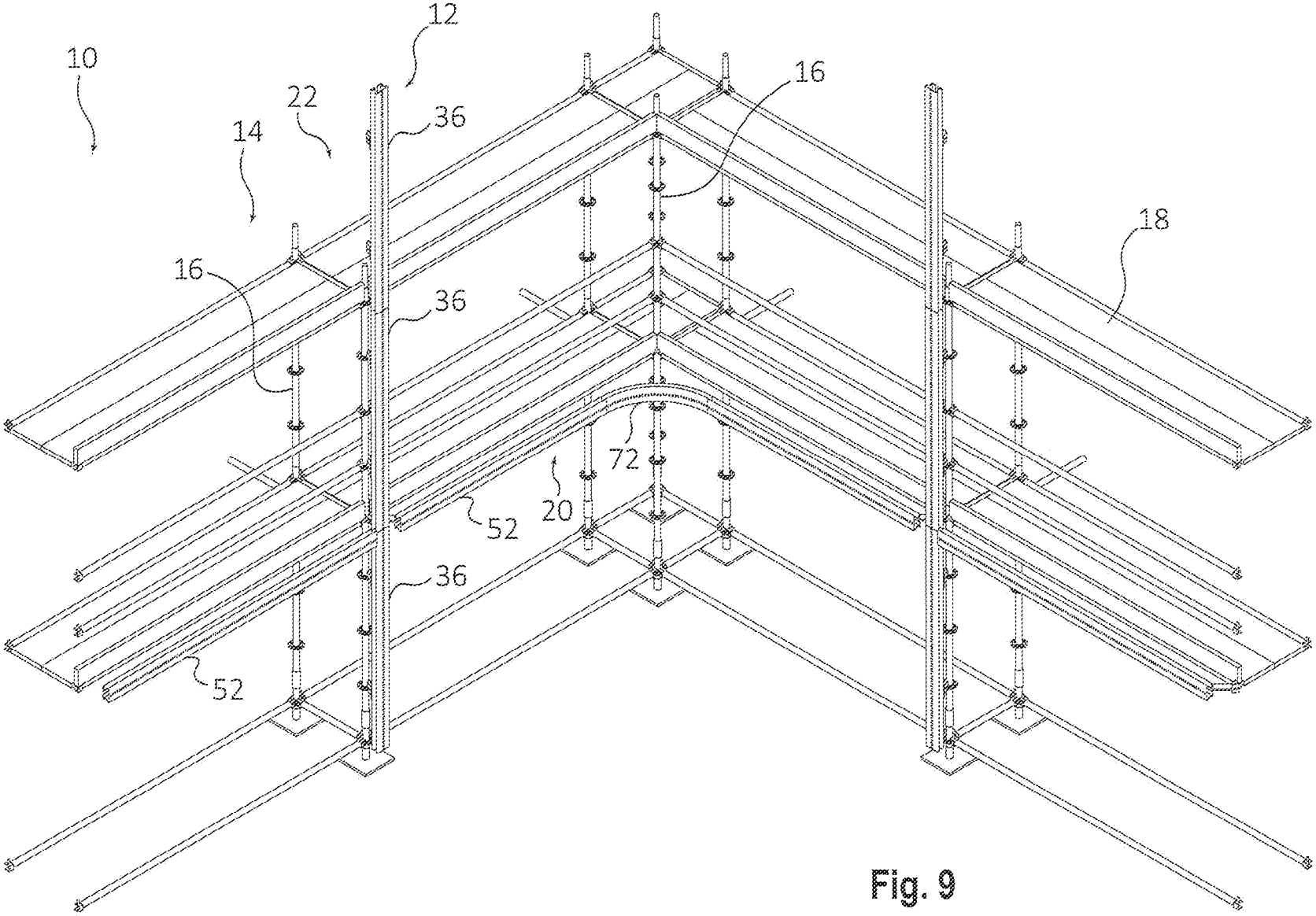

In the embodiment shown in FIG. 8, the curved rail element 72 is an outer curved element. In the representation represented in FIG. 9, a curved rail element 72 is shown, which makes an inner curve possible.

By means of the different curved rail elements 72, thus outer curve element and inner curve element, it is possible in general for the rail system 12 and thus the scaffold transport system 10 to also be able to cover scaffolds 14 with complex shapes.

As follows from the figures, the scaffold transport system 10 and the method explained can be used both for erecting scaffolding and dismantling scaffolding. Furthermore, the scaffold transport system 10 and the method explained can be used for transporting material, for example building material, or people, in particular in the case of an already completed scaffold 14. The scaffold 14 can then be regarded as transporting scaffold for the scaffold transport system 10.

Because of the automated scaffold transport system 10, the objects are transported efficiently since the transporting is effected in an automated manner. If several carriage modules 28 are used, in addition a constant flow of material is guaranteed, since material can be provided at a desired rate in spite of long distances.

In this way, an efficient scaffold transport system 10 and method is provided, with which in particular the erection and dismantling of scaffolding is simplified and speeded up. At the same time, safety is increased since human errors are reduced to a minimum.

To control the scaffold transport system 10, in particular the movement of the individual carriage modules 28 (see FIG. 1), a system controller 78 is provided.

By means of the system controller 78, the individual carriage modules 28 are actuated, wherein the system controller 78 can be formed as a central unit, which communicates with the carriage modules 28, or as a decentralized unit, which comprises several control modules which communicate with each other, in order together to form the system controller 78. In the case of the decentralized variant, the carriage modules 28 each comprise a control module, for example, wherein the carriage modules 28 communicate with each other.

In the embodiment shown, a hybrid form is provided according to which the system controller 78 comprises a central control unit 80 and the individual carriage modules 28 each comprise control modules 81, which all communicate with each other.

The central control unit 80 can be operated by the user, in order to control the at least one carriage module 28. The central control unit 80 is, for example, a portable device, which is carried by the user.

Several (central) control units 80 can also be provided, which are either allocated to a particular section of the rail system 12, that is the carriage modules 28 located there. In the case of several control units 80, it can also be provided that these have a hierarchy, with the result that a (central) control unit 80 forms the primary control unit.

By means of the at least one (portable) central control unit 80, among other things the following functions of the scaffold transport system 10 can be easily implemented:

- Updating the position of the user, thus of the worker, who is carrying the central control unit 80,
- Transmitting stop or emergency stop commands for the at least one carriage module 28,
- Pausing/resuming the implementation or movement of the at least one carriage module 28, and/or
- Transmitting manual or semi-manual movement commands to the at least one carriage module 28.

In this way, by means of the (portable) central control unit 80, the user can actively intervene in the movement sequences of the at least one carriage module 28, or his position is transmitted, in order to prevent a collision, as has already been explained above.

In general, it can be provided that the system controller 78 comprises artificial intelligence or machine-learning technologies which make it possible for the actuation of the carriage modules 28 to become more efficient and/or more autonomous in the course of the operation of the scaffold transport system 10.

Furthermore, the system controller 78 can take into consideration different safety protocols or safety regulations in the actuation of the individual carriage modules 28, in order to comply with desired safety standards. In particular, the system controller 78 takes into consideration that people are not put at risk, with the result that essentially a sufficiently large distance is maintained between a moving carriage module 28 and a person.

The system controller 78 can access sensor data, which are captured by sensors 82, which are carried, for example, on the individual carriage modules 28, the rail system 12, in particular intersections 24, and/or the people located on site. Accordingly it is possible, among other things, to automatically detect the position of the workers and/or the carriage modules 28 and to take this into consideration when actuating the movement of the carriage modules 28 such that people are not endangered and carriage modules 28 do not collide with each other.

In general, the scaffold 14 can be erected in that the first two to three scaffold tiers or scaffold bays are still erected conventionally, wherein the horizontally running rail section 20 is installed on the first tier of scaffolding.

Starting from here, material, in particular scaffold elements 16 and/or rail elements 23, can be transported to the desired places of use by means of the carriage module 28, in order to extend the rail system 12 and/or the scaffold 14. The rail system 12 can be extended in the desired manner because of the modular construction of the individual rail elements 23.

If a two-dimensionally closed rail system area 26 has been created, a continuous flow of material can be provided, in that, for example, several carriage modules 28 are operated at the same time by means of the system controller 78 (see FIG. 1). The efficiency can be correspondingly increased in this way.

Because of the sensors used, which the workers who are located on the scaffold 14 are carrying, the corresponding unloading positions can be defined to coincide with the locations at which the workers are located. This ensures that the material is delivered to the desired place of use.

In order to find the optimum possible movement path, the system controller 78 can have captured the rail system 12 by control system means, for example as a two- or three-dimensional map. The intersections 24 can represent reference points or nodes for the system controller 78.

In general, the scaffold transport system 10 can be operated manually by means of a control unit, in a partly automated or fully automated manner, wherein the degree of automation depends on the wishes of the operator of the scaffold transport system 10.

For example, in the case of partly automated control, the speed of the carriage modules 28 can be adjusted, wherein in fully automated operation a maximum speed of up to 60 m/min is provided. In the case of partly automated control, it can also be provided that the workers input manually whether the corresponding carriage module 28 has been unloaded or loaded.

In general, the carriage modules 28 are designed to transport at least double their tare weight as a load, for example a load of at least approx. 60 kg in the case of a tare weight of 30 kg, wherein the carriage modules 28 can usually transport loads of more than 100 kg.

The energy supply of the individual carriage modules 28 is guaranteed via batteries, for example Li-ion batteries, which can be formed as accumulators. The system controller 78 can monitor the battery status of the carriage modules 28 and actuate them such that they are automatically moved to a charging point when the charge status is critical.

The corresponding carriage module 28 can then be replaced by an already completely charged carriage module 28, which is possible because the carriage modules 28 are modular and thus universally usable. Charging a discharged carriage module 28 takes approx. 1 to 5 hours.

As an alternative to the embodiments shown with the separately formed rail elements 23, scaffold elements 16 can also be provided, which already comprise the respective rail sections 20, 22 in an integral manner. The rail system 12 is therefore implemented at the same time as the scaffold 14.

Figure 10:
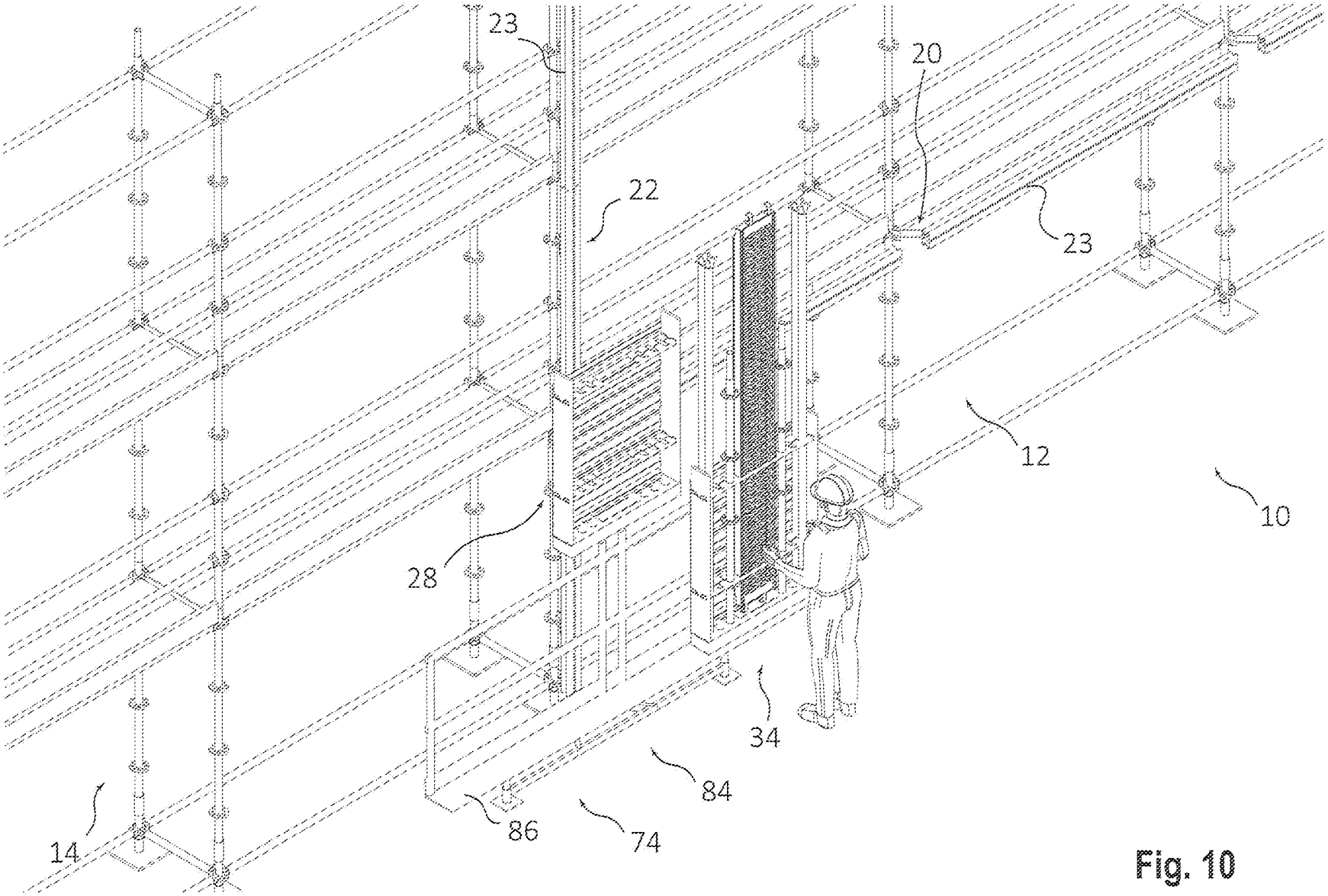

The section of the scaffold transport system 10 shown in FIG. 10 shows a changing station 84, at which a carriage module 28 can be reloaded, in that a new load-bearing unit 34 is coupled to the carrier section 32 of the carriage module 28.

The new load-bearing unit 34 can already be pre-loaded in the changing station 84, such that the (empty) load-bearing unit 34 brought back by the carriage module 28 is replaced by the new (loaded) load-bearing unit 34. The efficiency can be correspondingly increased in this way, since the carriage module 28 is merely decoupled from the old load-bearing unit 34 and coupled to the new load-bearing unit 34.

For this purpose, the changing station 84 can comprise a changing platform 86, such that the load-bearing unit 34 is located at a suitable height for the operator.

In this respect, at least one loading position 74 is located at the changing station 84.

The changing station 84 can generally be used in the scaffold transport system 10.

By way of example, the scaffold transport system 10 comprises several changing stations 84, for example an upper changing station 84 for unloading and a lower changing station 84 for loading the respective carriage module 28. The efficiency can be increased even further in this way, since no time is lost by loading or unloading.

Figure 11:
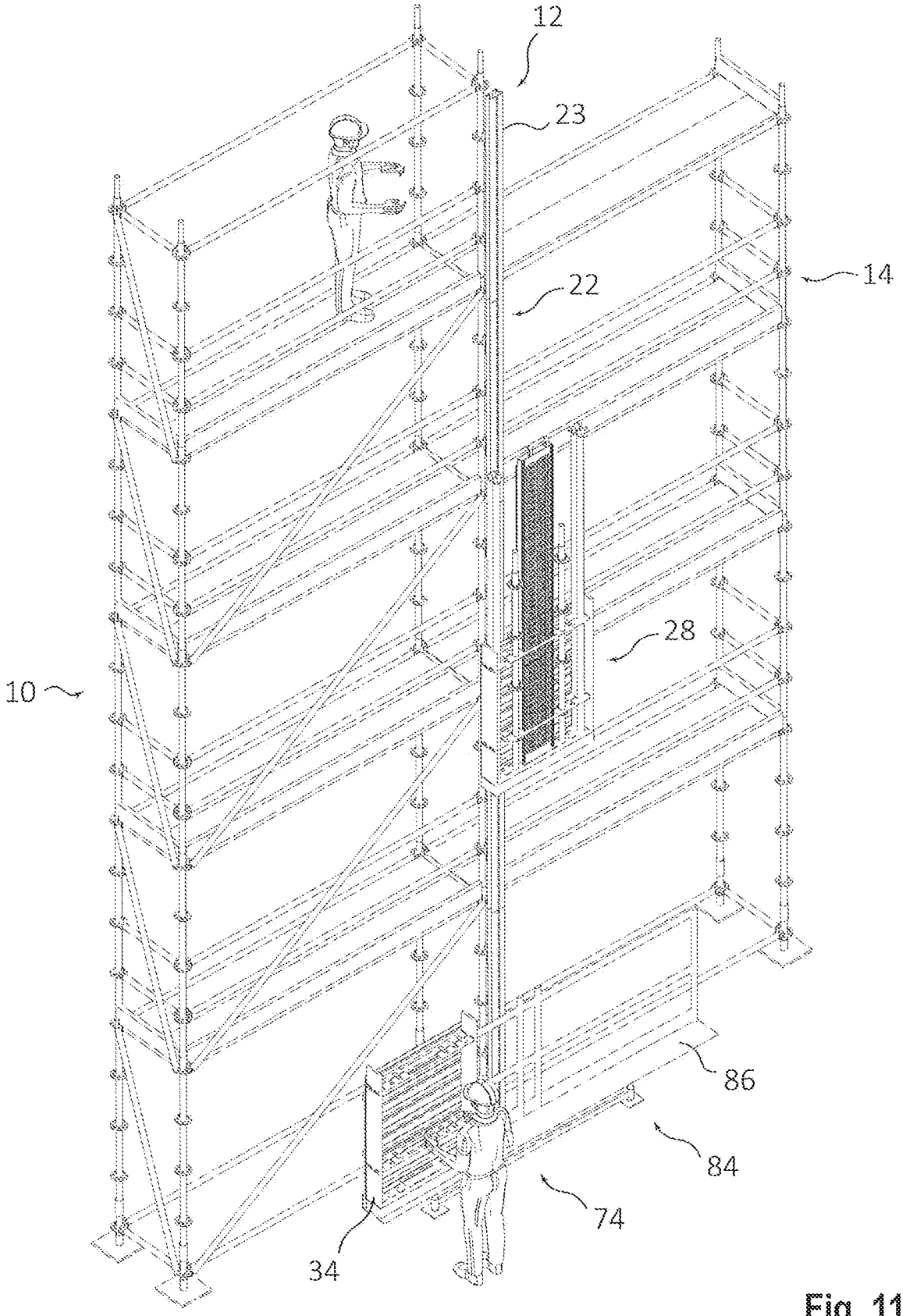

In FIG. 11, a further scaffold transport system 10 is shown, which only has a vertically running rail section 22, in particular consists thereof. The carriage module 28 therefore moves along the vertically running rail section 22 in order to transport building material or similar from a lower tier, in particular the base, to a higher tier of the scaffolding 14.

The carriage module 28 can be formed in an analogous manner to the previous embodiments.

The invention claimed is:

1. A scaffold transport system comprising a rail system having at least one horizontally running rail section, at least one vertically running rail section, and at least one carriage module, which is designed to move along the rail system, wherein the at least one vertically running rail section is coupled to the at least one horizontally running rail section, wherein the vertically running rail section and the horizontally running rail section remain static to each other during operation, wherein the at least one carriage module has a coupling section via which the at least one carriage module is captively and movably coupled to the at least one horizontally running rail section and to the at least one vertically running rail section, and the coupling section having at least one gripper unit, by means of which the carriage module is captively and movably coupled to the rail system having the at least one horizontally running rail section and the at least one vertically running rail section, wherein the at least one carriage module has a carrier section by means of which the carriage module carries objects during movement, wherein the vertically running rail section and the horizontally running rail section are configured such that the carriage module can be moved along both rail sections, wherein the scaffold transport system comprises a system controller which is designed to control the movement of the at least one carriage module along the at least one horizontally running rail section and the at least one vertically running rail section, wherein the carriage module has a drive that is integrated in the carriage module, wherein the drive ensures that the carriage module travels along the vertically running rail section and the horizontally running rail section automatically, wherein the scaffold transport system comprises a scaffold, wherein the scaffold has scaffold elements and the rail system is formed by the scaffold elements in each of which rail sections are integrated and/or wherein the rail system comprises several modular rail elements which are fastened to the scaffold via fastening means, and wherein the gripper unit is formed such that the gripper unit has a clasping section that at least partially clasps around and behind edges of the rail elements or the rail sections of the rail system in order to be correspondingly captively coupled to the rail system.

2. The scaffold transport system according to claim 1, characterized in that the rail system has at least one two-dimensionally closed rail system area, and wherein several rail system areas are provided connected to each other.

3. The scaffold transport system according to claim 1, characterized in that the carrier section has a modular formation such that different load-bearing units can be coupled to the carrier section.

4. The scaffold transport system according to claim 1, characterized in that the coupling section has at least one sliding unit, by means of which the carriage module slides along the rail system.

5. The scaffold transport system according to claim 1, characterized in that several carriage modules are provided.

6. A method for controlling a scaffold transport system according to claim 1, with the following steps:

loading the carriage module in a loading position, moving the carriage module along the rail system, and unloading the carriage module in an unloading position.

7. The scaffold transport system according to claim 1, characterized in that the rail system has at least one two-dimensionally closed rail system area, and wherein several rail system areas are provided connected to each other, wherein the rail system is formed by the scaffold elements in each of which rail sections are integrated.

8. The scaffold transport system according to claim 1, characterized in that the rail system has at least one two-dimensionally closed rail system area, and wherein several rail system areas are provided connected to each other, wherein the carrier section has a modular formation such that different load-bearing units can be coupled to the carrier section.

9. The scaffold transport system according to claim 1, characterized in that the rail system has at least one two-dimensionally closed rail system area, and wherein several rail system areas are provided connected to each other, wherein the coupling section has at least one sliding unit, by means of which the carriage module slides along the rail system.

10. The scaffold transport system according to claim 1, characterized in that the carrier section has a modular formation such that different load-bearing units can be coupled to the carrier section, wherein the coupling section has at least one sliding unit, by means of which the carriage module slides along the rail system.

11. A scaffold transport system comprising a rail system having at least one horizontally running rail section, at least one vertically running rail section, which is coupled to the at least one horizontally running rail section, and at least one carriage module, which is designed to move along the rail system, wherein the at least one carriage module has a coupling section via which the at least one carriage module is captively and movably coupled to the rail system, and the coupling section having at least one gripper unit, by means of which the carriage module is captively and movably coupled to the rail system having the at least one horizontally running rail section and the at least one vertically running rail section, wherein the at least one carriage module has a carrier section by means of which the carriage module carries objects during movement, wherein a system controller is provided which is able to control the movement of the at least one carriage module along the at least one horizontally running rail section and the at least one vertically running rail section, the carriage module being designed as a robot whose movement process is controlled by the system controller, wherein the carriage module has a drive that is arranged within a housing of the carriage module, wherein the drive ensures that the carriage module travels along the at least one horizontally running rail section and the at least one vertically running rail section automatically, wherein the system controller is configured to access sensor values in order to actuate a movement of the at least one carriage module along the at least one horizontally running rail section and the at least one vertically running rail section, wherein the scaffold transport system comprises a scaffold, wherein the scaffold has scaffold elements and the rail system is formed by the scaffold elements in each of which rail sections are integrated and/or wherein the rail system comprises several modular rail elements which are fastened to the scaffold via fastening means, and wherein the gripper unit is formed such that the gripper unit has a clasping section that at least partially clasps around and behind edges of the rail elements or the rail sections of the rail system in order to be correspondingly captively coupled to the rail system.

12. The scaffold transport system according to claim 1, characterized in that the gripper unit comprises a clasping section with an arm, wherein the arm together with a rolling element guarantees that the rail element or the rail section is at least partially clasped.

13. The scaffold transport system according to claim 11, characterized in that the gripper unit comprises a clasping section with an arm, wherein the arm together with a rolling element guarantees that the rail element or the rail section is at least partially clasped.

* * * * *